United States Patent [19]

Kuehnle

[11] 4,236,807

[45] Dec. 2, 1980

[54] MODULAR ELECTROPHOTOGRAPHIC COPYING MACHINE

[75] Inventor: Manfred R. Kuehnle, Lexington, Mass.

[73] Assignee: Coulter Systems Corporation, Bedford, Mass.

[21] Appl. No.: 11,307

[22] Filed: Feb. 12, 1979

[51] Int. Cl.[3] ..... G03G 15/00

[52] U.S. Cl. ..... 355/3 R; 355/16

[58] Field of Search ..... 355/3 R, 11, 3 SH, 16, 355/3 BE

[56] References Cited

U.S. PATENT DOCUMENTS

| | | | |
|---|---|---|---|
| 3,600,082 | 8/1971 | Knechtel | 355/16 X |
| 3,698,804 | 10/1972 | Cranskens et al. | 355/3 SH |
| 3,861,306 | 1/1975 | DuBois et al. | 355/3 R X |
| 4,114,999 | 9/1978 | Kogiso et al. | 355/1 X |

*Primary Examiner*—R. L. Moses

*Attorney, Agent, or Firm*—Silverman, Cass & Singer

[57] ABSTRACT

An electrophotographic copy machine formed as an assembly of three removably mounted self-contained operational modules. A mechanical assembly module includes the platen for supporting the original document, a paper supply and feed mechanism and an electrophotographic imaging apparatus. The electrophotographic imaging apparatus includes an endless electrophotographic belt operative through a charging station, an imaging station, a toning station and an image transfer station. The second module contains all but the toning station which comprises the third self-contained module. A cabinet assembly for receiving and holding the three modules in assembly is provided and further mounts the miscellaneous switches, controls and associated electronics of the system copying machine.

5 Claims, 6 Drawing Figures

FIG. 1
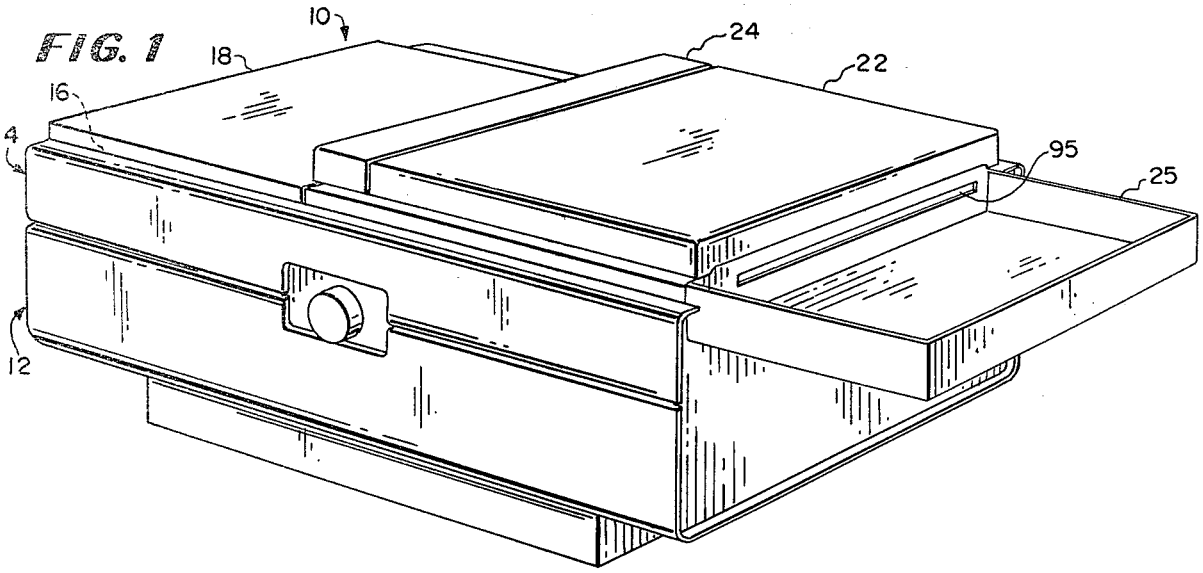
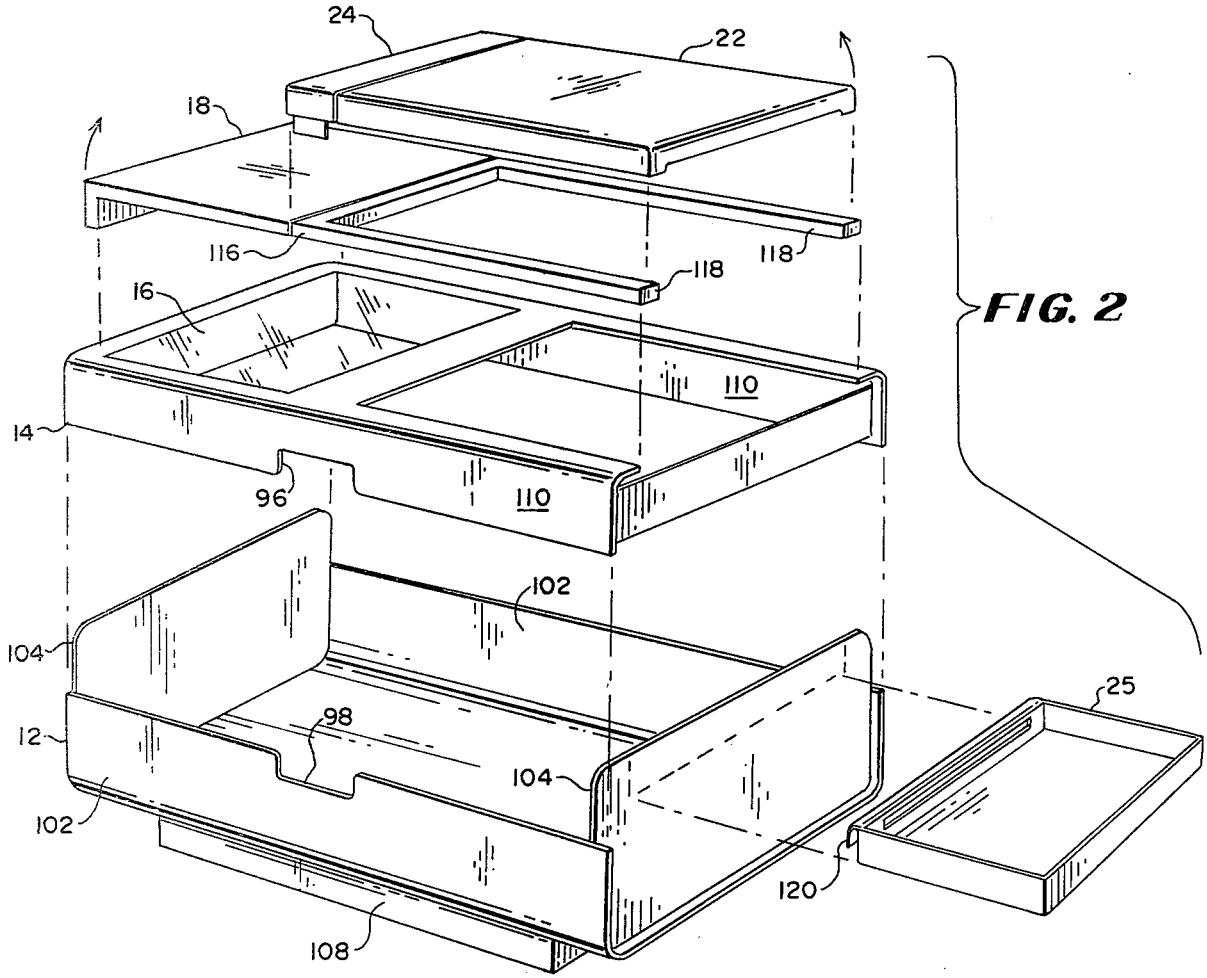
FIG. 2

MODULAR ELECTROPHOTOGRAPHIC COPYING MACHINE

BACKGROUND OF THE INVENTION

This invention relates generally to electrophotographic copying machines and more particularly, provides an electrophotographic copying machine formed as an assembly of self-contained modules removably mounted in a cabinet, each module containing a particular functional system of the machine.

Electrophotographic copying machines are well known in the art. Generally speaking, these machines include an electrophotographic member which is transported past or through a plurality of stations, each of which performs a functional operation of the reproducing procedure. The electrophotographic member can be constructed in the form of a drum, a plate or an endless belt. For high speed applications, it has been found advantageous to employ an electrophotographic member in the form of an endless belt mounted on rollers and to expose the belt to an image of the document to be copied at a location where the belt is in a flat condition.

The work stations generally include a charging station at which a uniform charge is applied to the photoconductive surface of the electrophotographic member; an exposure or imaging station at which the charged photoconductive surface is exposed to a light image of the document to be copied creating thereby a latent electrostatic image; a developing or toning station at which the latent electrostatic image is developed or made visible through the application of finely divided, charged toner particles that adhere to the photosensitive surface in a configuration defined by the latent electrostatic image; a transfer station at which the developed image is transferred to a secondary carrier medium such as paper and a fixing station at which the transferred image is affixed permanently to the secondary carrier medium.

In some machines, additional work stations are included, such as a cleaning station for removing residual toner from the electrophotographic member prior to reuse. In other machines one or more of the above work stations are omitted. For example, the transfer station can be eliminated and the toned image is permanently fixed onto the electrophotographic member which then becomes the final copy.

Little attention has been directed to the overall construction and assembly of the copying machine.

Generally, each of the functional operating work stations has been assembled with the others as individually mounted elements mounted fixedly either on the principal frame of the machine or to some supporting structure secured to said frame. The final assembly is performed of necessity in situ at installation of the machine where the machine is built up from "scratch" from a plurality of individual parts. Once assembled, the compulsory attendance of a skilled serviceman at the place of installation is mandatory. This involves considerable expense as well as delay in effecting repairs. Repairs must be made at the site. The machine cannot be dismantled with the defective section withdrawn and removed for service at a central location with a substitute operating section installed in place so that the machine can be operated during the duration of repairs, etc. Down-time during awaiting of service and the pendency of repairs is of considerable disadvantage.

Considerable need has arisen for the provision of an essentially modular machine comprising plural self-contained units or modules preassembled and installable to construct the machine. Not only can expenses involved in construction and installation be materially reduced, but the in situ assembly of the multitudinous parts for installation of the machine does not involve a practical assembly of each and all of the functional or operational systems from "scratch" at the installation site. Provision of modular units additionally simplifies repair with minimum down-time by permitting withdrawal of the defective module and replacement thereof by a properly operating module on site. The defective module can be transported to a service center rather than requiring on site repair by the skilled serviceman. With a modular system, even the operation of the machine can make the substitution.

Advances in copier technology have been rapid with development of new specifically functional operational systems. A machine may become obselete in short order. A modular system would enable substitution of improved functional systems into an established, i.e. older, machine and thus extend the useful life of the machine.

Insofar as applicant is aware, modular systems of the type referred to have not been developed, notwithstanding their likely advantage and utility.

SUMMARY OF THE INVENTION

An electrophotographic copying machine constructed according to this invention includes an external cabinet assembly and three removably mounted, self-contained modules. A module includes a copy platen for supporting the document to be copied, a paper supply and feed mechanism; an electrophotographic belt, mounting and drive means supporting and guiding the electrophotographic bell through plural work stations, charging means and an image transfer means. A second self-contained module is the optical assembly module which includes an optical projecting system for projecting an image of the document to be copied from the document to the electrophotographic belt. The third self-contained module is the toner assembly module and includes a toning device for applying toner particles to the latent electrostatic image formed on the electrophotographic belt. The optical assembly module is mounted removably upon the external cabinet assembly. The toner assembly module is slidably mounted on the optical assembly module and the mechanical assembly module is removably mounted upon the toner assembly module. Mounting may be effected by providing seating means on each module to facilitate the mounting thereof, one on the other, in the order described.

BRIEF DESCRIPTION OF DRAWINGS

In the drawings wherein like reference numerals represent like parts:

FIG. 1 is a perspective view of an electrophotographic copying machine assembly constructed and assembled according to this invention;

FIG. 2 is an exploded view of the external cabinet of the electrophotographic copying machine assembly of FIG. 1;

DESCRIPTION OF THE PREFERRED EMBODIMENT

Figure 3:
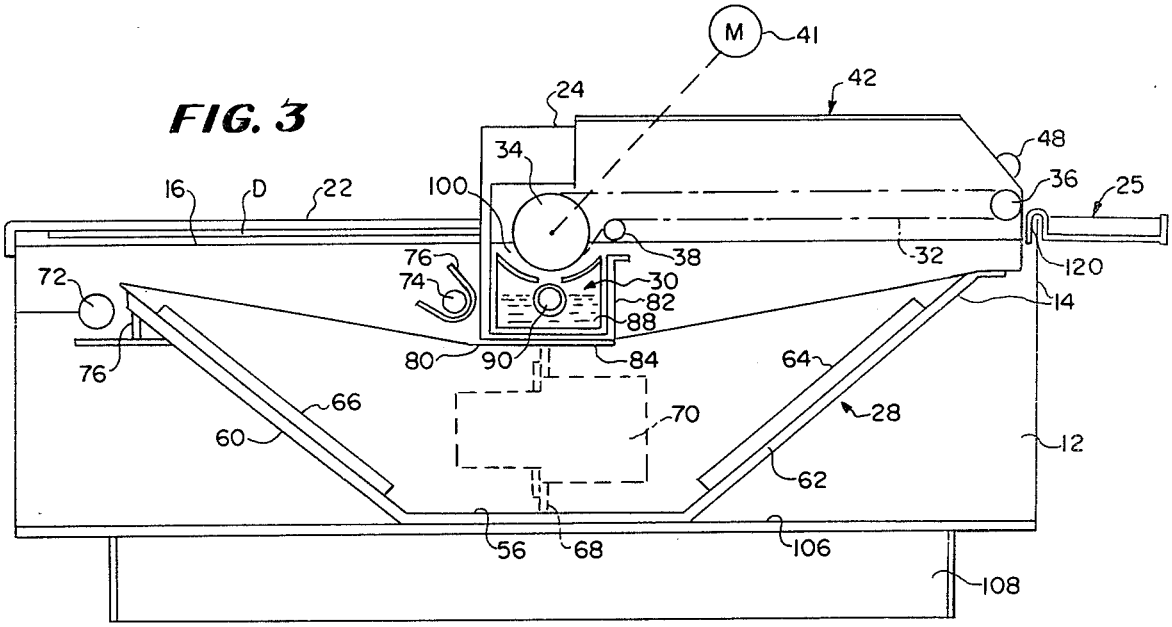
FIG. 3 is a sectional view of the electrophotographic copying machine of FIG. 1 illustrating the three modular components thereof in assembled condition.

Referring now to the drawings, in FIG. 1 there is illustrated an electrophotographic copying machine 10 constructed according to the invention. Copying machine 10 includes a rectangular, box-shaped, open top lower cabinet 12 for holding the component parts of the machine 10 and rectangular frame-shaped upper cabinet 14 on which is mounted copy platen 16. A platen cover 18 is located above the copy platen 16 and is hingedly mounted for pivotal movement thereon (as shown in FIG. 2). A paper supply unit 20 and an access cover 22 thereto is located above and to the right of the platen cover 18 as viewed in FIG. 1. Control box 24 is located adjacent to the cover 22 and alongside the pivot axis of platen cover 18. Control box 24 holds the various switches, timers and associated electronics for machine 10. A copy delivery tray 25 is seated at one end of the lower cabinet 14 and mounts the control panel therefor.

Figure 4:
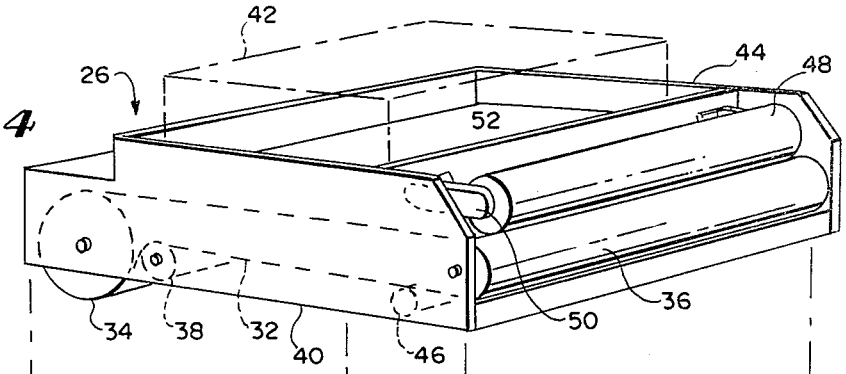
FIG. 4 is a perspective view of the mechanical assembly module illustrated in FIG. 3.
Figure 5:
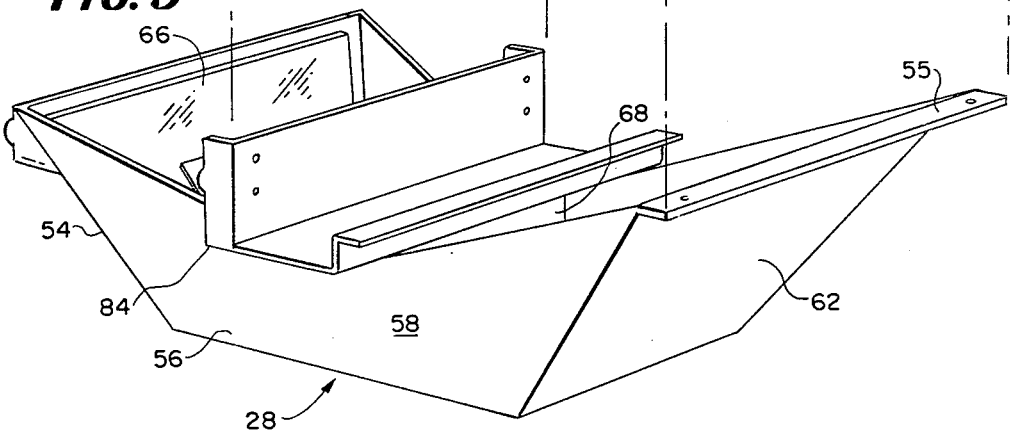
FIG. 5 is a perspective view of the optical assembly module illustrated in FIG. 3.
Figure 6:
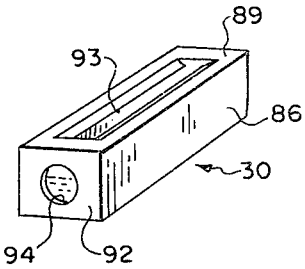
FIG. 6 is a perspective view of the toner assembly module illustrated in FIG. 3.

Referring to FIGS. 3 and 4 for the operational elements of machine 10, there are illustrated three self-contained modules including mechanical assembly module designated generally by reference numeral 26, an optical assembly module designated generally by reference numeral 28 and a removably mounted toner assembly module designated generally by reference numeral 30.

The mechanical assembly module 26 contains an electrophotographic belt 32 supported on rollers 34, 36 and suitably positioned by a guide roller 38, each of which are journaled for rotational movement on a generally rectangular shaped frame member 40. Support roller 34 functions as a drive roller and is coupled to a drive motor 41 which also may be mounted on frame member 40.

Paper supply and feed device 42 is mounted on the top edge 44 of frame member 40. Corona generating device 46 is mounted on frame 40 parallel to the rollers 34,36 for applying an electrostatic charge to the belt 32. Transfer pressure roller 48 is mounted to brackets 50 secured to brace 52 secured to the frame 40. Transfer roller 48 effects the transfer of the toned image formed on the belt 32 to a sheet of paper fed from the paper supply and feed device 42.

The optical assembly module 28 includes an open top basket shaped member 54 having a bottom wall 56, a pair of connecting walls 58 and a pair of inclined end walls 60 and 62 which extend outward from the bottom wall 56 at identical angles of 45° but in opposite directions. Planar mirrors 64 and 66 are mounted on the inner facing surfaces of end walls 60 and 62. The member 54 has a vertically arranged partition 68 upward from the bottom wall 56. A lens system 70 is mounted to partition 68. A pair of lamps 72 and 74 and associated reflectors 76 being mounted to the member 54 adjacent notch 80 formed in the connecting walls 58. A well 82 is seated in notches 80 for accommodating the toner assembly module 30 transverse the open top of basket member 28. The opposite ends 84 of well 82 extend outward from basket 28.

The toner assembly module 30 slidably is mounted in well 80 and includes an elongated rectangularly shaped container 86 in which a quantity of liquid toner 88 is disposed. Feed roller 90 is mounted within the container 86 adjacent slotted top wall 89. Front wall 92 of container 86 may be provided with a window 94 for viewing the level of liquid toner 88 therein. Top wall 89 carrying slot 93 may be arcuate and may have a radius of curvature similar to that of roller 34.

When installed in well 86, a gap 100 is defined between said roller 34 and wall 89.

For assembly of the modules into machine 10, the optical assembly module 28 first is inserted in the lower cabinet 12. Then the mechanical assembly module 26 is placed in the proper position above the optical assembly module and seated. Toner assembly module 30 next is introduced into machine 10 through the opening defined by notches 96 and 98 in the lower cabinet 12 and upper cabinet 14 respectively and is slidably engaged within well 80.

The mechanical assembly module 26 is seated on optical assembly module with the frame resting on the well 86 and upon flange 55 of basket 54. Suitable means such as pins and apertures may be provided on floor 56 of basket 54 and floor 106 of cabinet 12 respectively for holding the basket in place.

Note that each module is self-contained and may be assembled as a unit at one location and installed as a unit at the site of installation of the machine. Each module readily is removable from the assembly easily for repair, replacement or substitution of one for another, say improved, assembly.

Machine 10 operated in a conventional manner. The document to be copied is placed down on the glass portion of copy platen 16 and the copy platen cover 18 is closed. The controls in box 24 are operated to initiate the cycle of operation.

Generating device 46 is energized and belt 32 is driven in a clockwise direction by rollers 34 and 36 for a period of time necessary to carry a portion of belt 32 past generating device 46. A desired charge potential is applied to the belt 32.

The charged portion of belt 32 then is transported to the exposure station which is located between rollers 34 and 36. Lamps 72 and 74 are energized. The image of the document D is projected to and from mirror 64 through lens system 70 to mirror 66 and thence to the underside or facing side of belt 32 carrying the charge. When the projected image of document D is applied to the charged portion of belt 70, a latent electrostatic image is formed on said portion by the selective discharge of the belt portion. Exposure is carried out for sufficient time within which to form the latent image.

After exposure, the portion of belt 32 carrying the latent image is transported through the toning station where it is toned or developed with liquid toner 88 as it passes through the gap between roller 34 and wall 89.

The position of the portion of belt 32 which carries the toned image then is moved to the slotted opening 100 in concave top wall 102 of the image transfer station where it is transferred to a sheet of paper, as the sheet of paper is passed between rollers 36 and 48.

The sheet of paper containing the toned image emerges from the machine 10 through an opening 95 where is drops into the tray 25.

As illustrated in FIG. 2, the walls 102 of lower cabinet 12 extend outward of the opposite side walls 104 of said cabinet. Walls 104 are higher than walls 102 and are spaced inward of the walls 102 and floor 106. Walls 102 and bottom wall or floor 106 may be formed of one channeled piece of metal. As shown, the cabinet 12 is supported by block 108.

The upper cabinet 14 includes side portions 110 having a length substantially the same as walls 102, said side portions including longitudinal lips 114. The platen 16 is seated on suitable bridging flanges 115 formed as a part of said upper cabinet 14.

The bridging end walls 116 of cabinet portion 14 are arranged to be seated between walls 104 of cabinet portion 12 with the lower edges of portions 110 of cabinet 14 resting upon the upper edges of walls 102 of cabinet portion 12. Notches 94,96 are aligned to provide entry for the toner assembly module 30. Platen cover 18 is hingedly coupled to U-shaped member 116, the free arms 118 thereof being seatable on lips 114 and adapted to be sandwiched by supply cover 22. The mechanical module and the optical assembly module are installed within the area enclosed by the cabinet portions 12 and 14. Supply cover 22 is seated on lips 114.

Tray 24 includes a lip 120 which slips over the top of bridging end wall 104 of cabinet 12 in position to receive finished copies from the transfer station.

Suitable fastening means such as screws, snaps, pins and apertures, latches, etc. may be provided, if desired, for securing the assembled cabinet portions and modules. When the modules and cabinet portions, etc. are assembled to define the operative machine 10, no adjustments need be made. All of the elements in each module are in their proper disposition so that when the said cabinet portions and modules are assembled, the machine 10 is in condition for operation.

This is what is meant by the term "self-contained" as applied to these modules.

Many variations in component elements may be effected without departing from the spirit and scope of the invention as defined in the appending claims.

I claim:

1. An electrophotographic copying machine for producing a copy of a document comprising:

(a) a modular enclosing external cabinet assembly;

(b) a self-contained mechanical assembly module enclosed within said external cabinet assembly for receiving an image of a document, converting said image into a latent electrostatic image, and then ejecting therefrom on a sheet of paper a toned image of said latent electrostatic image, said mechanical assembly further including a supporting frame, a plurality of electrophotographic belt supporting rollers mounted on the frame, an electrophotographic belt mounted on said plurality of rollers to define a pair of generally parallel reaches, a drive motor operably connected to one of said rollers, a charging device mounted on said supporting frame disposed adjacent the belt in the vicinity of the lower reach thereof, and (c) a self-contained optical assembly module removably mounted in said external cabinet assembly for projecting an image to the mechanical assembly module, and said optical module comprising an open-top housing of frusto conical configuration and seating an optical projection system therein, said housing including opposite wall means including notch means opening upwardly thereof, and (d) a self-contained toner assembly module removably mounted relative to said optical assembly module for toning the latent assembly electrostatic image formed within the mechanical assembly module, the said toner assembly being removably seated within said notch means nested within said housing in noninterferent relationship with said optical projection system, said toner supply module comprising a container support seated in said notch means, a container having a slotted top wall, accommodated within the container support, a supply of liquid toner in the container and a feed roller within the container for leading liquid toner through said slotted top, said slotted top of said container being located in proximity to the lower reach of said electrophotographic belt when the container is seated in said container support, and (e) an image transfer device, including a transfer roller mounted on said supporting frame for transferring the toned image to a carrier sheet for delivery thereof to the exterior of said cabinet assembly.

2. The electrophotographic copying machine as claimed in claim 1 and wherein said charging device comprises a corona generating device.

3. The electrophotographic copying machine as claimed in claim 1 and wherein the optical projection system comprises a pair of opposed 45° mirrors and a lens system positioned between said 45° mirrors.

4. The electrophotographic copying machine as claimed in claim 3 and wherein the optical assembly module further includes means for illuminating the document.

5. The electrophotographic copying machine as claimed in claim 1 and wherein the external cabinet assembly includes:

(a) a lower generally rectangular, open topped cabinet portion having upright surrounding walls;

(b) an upper cabinet portion removably mounted on the said walls across the top of the lower cabinet portion, the upper cabinet having surrounding walls coextensive with the surrounding walls of the lower cabinet portion;

(c) a platen, and (d) a platen cover mounted on the surrounding walls of said upper cabinet portion; and (e) an access cover also mounted on the surrounding walls of said upper cabinet portion adjacent to the platen cover.

* * * * *